United States Patent [19]

Zur

[11] Patent Number: 4,769,914

[45] Date of Patent: Sep. 13, 1988

[54] LETTERING DEVICE

[75] Inventor: Reinhard Zur, Hamburg, Fed. Rep. of Germany

[73] Assignee: Koh-I-Noor Rapidograph, Inc., Bloomsbury, N.J.

[21] Appl. No.: 39,150

[22] Filed: Apr. 16, 1987

[30] Foreign Application Priority Data

Apr. 23, 1986 [DE] Fed. Rep. of Germany ..... 3613777

[51] Int. Cl.[4] ..... B43L 13/02

[52] U.S. Cl. ..... 33/18.1; 33/1 M; 33/430

[58] Field of Search ..... 33/18.1, 430, 438, 1 M, 33/23.01, 23.03, 25.1, 25.2, 25.3, 25.4, 25.5

[56] References Cited

U.S. PATENT DOCUMENTS

| | | | |
|---|---|---|---|
| 860,562 | 7/1907 | Paddack | 33/25.4 |
| 2,675,291 | 4/1954 | Webster . | |
| 2,701,176 | 2/1955 | Baumgard . | |
| 3,119,184 | 1/1964 | Projansky | 33/25.5 |
| 3,154,855 | 11/1964 | Pelton . | |
| 3,396,402 | 8/1968 | De Mey . | |
| 3,491,716 | 1/1970 | Ranford . | |
| 4,327,596 | 5/1982 | Simon . | |
| 4,356,632 | 11/1982 | Anderka | 33/430 X |
| 4,412,383 | 11/1983 | Landa . | |
| 4,420,886 | 12/1983 | Amano . | |
| 4,459,602 | 7/1984 | Anderka . | |

FOREIGN PATENT DOCUMENTS

| | | | |
|---|---|---|---|
| 637872 | 2/1928 | France | 33/25.1 |
| 66775 | 3/1965 | France | 33/25.5 |
| 449275 | 9/1968 | Switzerland . | |

*Primary Examiner*—Harry N. Haroian

*Attorney, Agent, or Firm*—David H. Semmes; Warren E. Olsen

[57] ABSTRACT

A lettering device having a writing arm (4) that is movable between a position of repose and a writing position and that receives a stylus that has a Bowden control (29) for moving the writing arm (4) between the position of repose and the writing position. The Bowden control is guided via an actuating lever (42) that is pivotably secured to a guide bearing (8), so that it is guided over two application zones (43, 44) displaced on opposite sides of the pivot axis (41) of the actuating lever (42) and spaced apart from one another. By tensing the Bowden cable control (21), one section (42') of the pivoting actuating lever (42) lifts the writing arm (41).

14 Claims, 2 Drawing Sheets

LETTERING DEVICE

BACKGROUND OF THE INVENTION

1. Field of the Invention

The invention relates to a lettering device having a keyboard portion for selecting the symbols to be written and a writing portion, optionally separate from the keyboard portion, which has a writing arm. The writing arm receives a stylus and is movable between a position of repose and a writing position. The writing arm is movable along cartesian coordinates by means of two motors, which are driven in accordance with the symbol to be written. The motors are disposed stationary relative to the coordinate origin, and the writing arm is secured such that it is movable in the direction of one coordinate on a guide rail that in turn is movable by the first motor in the direction of the other coordinate and such that it is movable in the direction of the other coordinate on a second guide rail that in turn is movable in the direction of the first coordinate by the second motor. The writing arm has a guide slit extending in the direction of its longitudinal extension and in the direction of the first guide rail, in which a guide bearing is guided, which is coupled to a stationary runner rail extending parallel to the second guide rail.

2. Brief Description of the Prior Art

In a known lettering device of this type (German Utility Model DE-GM No. 79 16 714 or U.S. Pat. No. 4,356,632), which is also produced and sold by rotringwerke Riepe KG under the name "NC-scriber"), a lowering strip extending parallel to the runner rail, and also parallel to the second guide rail, extends underneath the writing arm at least over the entire region transversed by the writing arm. This lowering strip, in its position of repose, keeps the writing arm in this position of repose and can be lowered by means of a lifting magnet so that the writing arm then drops into the writing position, by its own weight.

Aside from the fact that the displacement movements of the lowering strip are noisy, movement of the lowering strip requires a relatively great expenditure of energy, since its massive design makes the lowering strip relatively heavy. Because of the attendant inertia, the speed of the lowering and raising movement of the lowering strip is also relatively low, which can limit the writing or drafting speed.

OBJECT AND SUMMARY OF THE INVENTION

It is an object of the invention to improve a lettering device such that raising and lowering the writing arm can be done with little expenditure of energy, very quickly and quietly.

To attain this object, a lettering device of the above type is embodied according to the invention such that an actuating lever that is pivotable about a pivot axis extending parallel to the first guide rail is secured to the guide bearing, which is in displaceable engagement, via two application zones located on different sides of and spaced apart from the pivot axis, with a Bowden control cable parallel to the runner rail and is movable by varying the tension in the Bowden control cable between a lowering position, in which the writing arm is in the writing position, and a raised position, in which with one section it is in lifting engagement with the writing arm.

In a lettering device according to the invention, the movement of the writing arm between the writing position and the position of repose is accordingly effected with the aid of a Bowden cable control, which has a very slight mass and therefore can be moved with little energy expenditure, very quickly, from a relatively weakly tensed state into a more strongly tensed state, and vice versa. If the Bowden control is weakly tensed, then the actuating lever, by its own weight and the influence of a spring, can pivot into a position in which it does not notably support the writing arm; that is, the writing arm is in the writing position. If the Bowden cable control is tensed more strongly, then its application at the two application zones, because of the resultant torque, causes a pivoting of the actuating lever about its pivot axis, causing a section of the actuating lever to engage the writing arm in such a way that the actuating lever lifts the writing arm by its pivoting movement, to put the writing arm into its position of repose.

To prevent pivoting movements of the actuating lever or braking of the displacement movement of the writing arm due to high friction between the Bowden cable control and the application zone (upon displacement of the writing arm in the direction of the runner rail in the application zones) the application zones may be embodied as rollers, secured such that they are rotatable on the guide rail about axes parallel to the pivot axis of the actuating lever.

One section of the lever preferably comprises a protrusion provided below the application zone and extending crosswise to the pivot axis of the actuating lever. As the actuating lever extends through the guide slit in the writing arm, this protrusion grips a zone of the guiding arm adjacent to the guide slit underneath and can thus raise the writing arm into the position of rest when the actuating lever is pivoted.

Tensing and relaxing of the Bowden cable control simply can be attained structurally by providing that one end of the Bowden cable control is retained nondisplaceably and the other end is secured to a lifting device, for example a lifting magnet.

The invention will now be described in further detail, according to the drawings which show an exemplary embodiment.

DESCRIPTION OF THE PREFERRED EMBODIMENT

Figure 1:
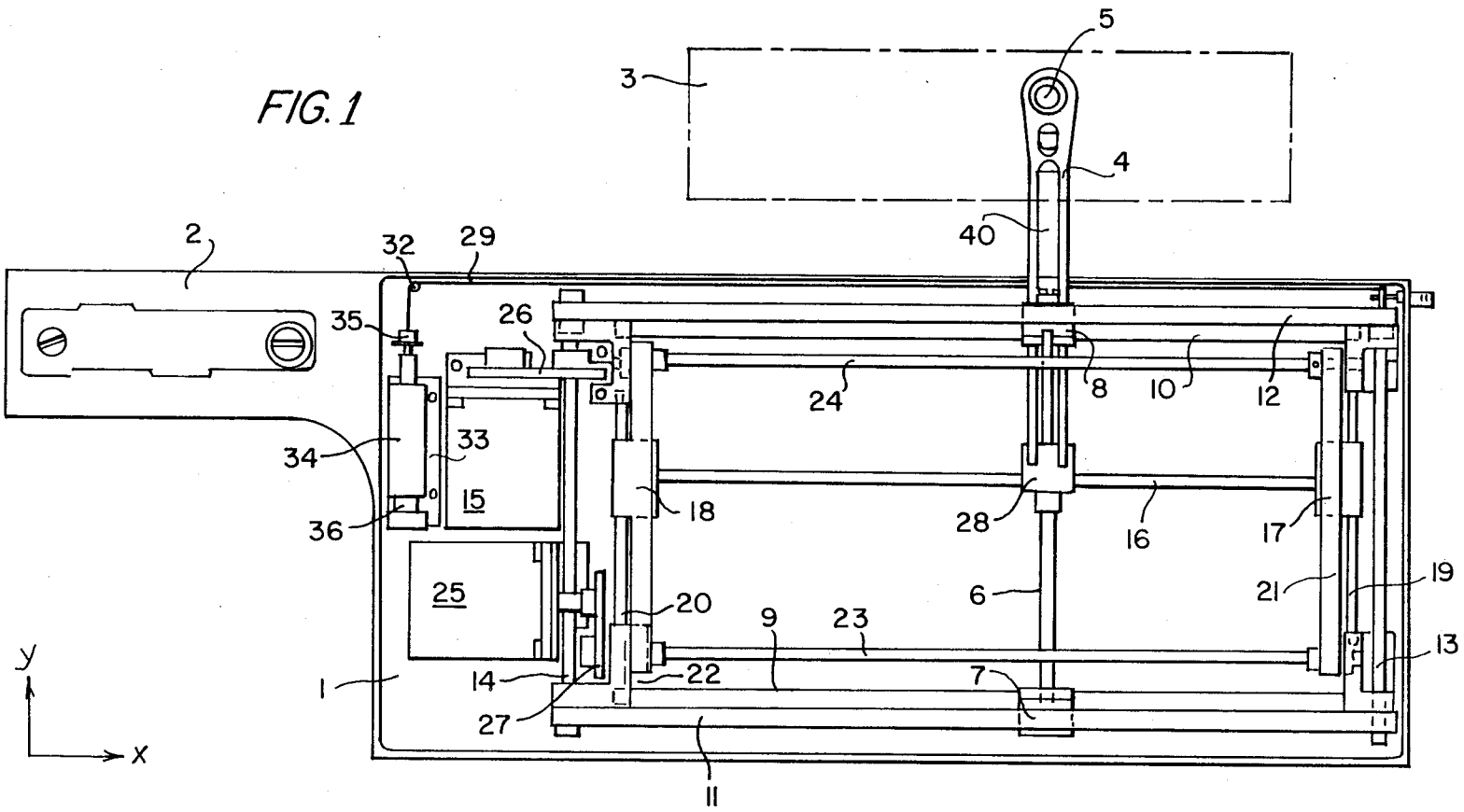
FIG. 1 is a plan view on a portion of a lettering device that can be secured to a drafting head, in which the cover that may optionally support the keyboard is omitted from the drawing.

FIG. 1 substantially shows the writing portion of a lettering device, which conventionally is adjoined laterally, to a fastener 2, for connection with the head of a drafting machine. Secured to the base plate are runner rails 9, 10 extending in the direction of the Y coordinate (see coordinate system as represented at the lower left) and runner rails 19, 20 extending in the X direction. Located between the runner rails 9, 10 is guide rail 6, which on its end has guide bearings, 7, 8 which are in displaceable engagement with the runner rails 9 and 10.

A guide rail 16 is correspondingly located between the runner rails 19 and 20, and on its ends it has guide bearings 17 and 18 which are in displaceable engagement with the runner rails 19, 20. In the area of intersection with the guide rails 6, 16, a slide bearing body 28 is provided, through which both the guide rail 6 and the guide rail 16 extend and on which the writing arm 4 is secured. This writing arm has a guide slit 40 extending in its longitudinal direction and extends substantially parallel to the guide rail 6. Extending through its guide slit 40 is a section of a guide bearing 8 (see FIG. 3), with respect to which the writing arm is movable back and forth in the direction of the longitudinal extension of its guide slit 40. As shown in FIG. 1 the writing arm 4 extends upward beyond the base plate 1, and a tubular writing pen holder 5 is to be inserted into its distal end.

It readily will be appreciated that by the combined movement of the guide rails 6 and 16 in the X and Y directions, any desired movement of the writing arm (and thus of the tubular writing pen 5) can be executed; i.e., the writing arm and thus the tubular pen 5 may, given a stationary position of the base plate 1, draw symbols within a writing field 3, the maximum length of which is set by the dimensions of the guide rail 16 and the maximum height of which is set by the dimensions of the guide rail 6.

Secured on the base plate 1 is a motor 15 for moving the guide rail 6 in the X direction and a motor 25 for moving the guide rail 16 in the Y direction. Via a gear 26 the motor 15 drives a shaft 14, which extends parallel to the guide rail 6 and is coupled, via timing belts 10, 11, to a shaft 13 adjoining the guide bearings 17 and extending parallel to the shaft 14, on the one hand, and on the other hand to the guide bearings 7 and 8. As a result, the guide bearings 7 and 8 can be moved back and forth in the X direction with exactly the same speed and always in an exactly parallel position in respect to the shafts 13 and 14.

Correspondingly, via a gear 27, the motor 25 drives a shaft 23 disposed parallel to the guide rail 16 through timing belts 21, 22, the shaft 23 will move a shaft 24 disposed parallel to the shaft 23, on the one hand, and on the other hand move the guide bearings 17 and 18. Hence, the guide rail 16 also is held in an exact parallel alignment with respect to the shaft 23 and is moved while so aligned.

For details of remaining basic structure of the lettering device, I incorporate by reference to the German utility model DE-GM No. 79 16 714, U.S. Pat. No. 4,459,602.

Figure 2:
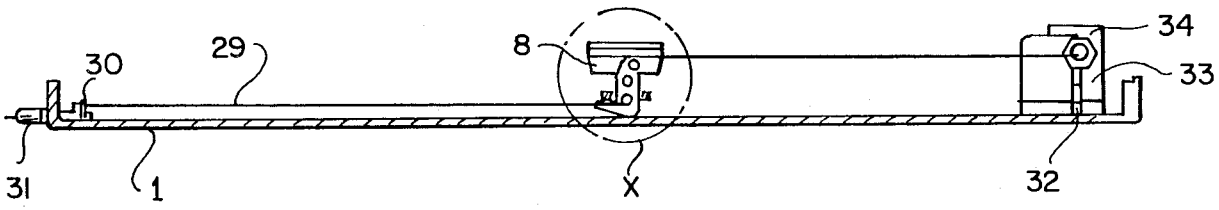
FIG. 2 is a fragmentary sectional view of the disposition of the Bowden control on the base plate of the lettering device.

For raising and lowering the writing arm 4, a Bowden cable control 29 is provided, which is secured on its right-hand side (with reference to FIG. 1) and on its left-hand side (with reference to FIG. 2) to a retaining element 30, that in turn is held on the base plate 1 by means of a threaded bolt 31. On its opposite side, the Bowden cable control 29 is guided over a deflection roller 32 and joined to the tappet 35 of a lifting magnet 34, which in turn is disposed on a holder plate 33 secured to the base plate 1. A compression spring 36 continuously exerts a force upon the tappet 35 leads to a tensile strain, defined by the force of the compression spring 36, in the Bowden cable control 29.

Figure 3:
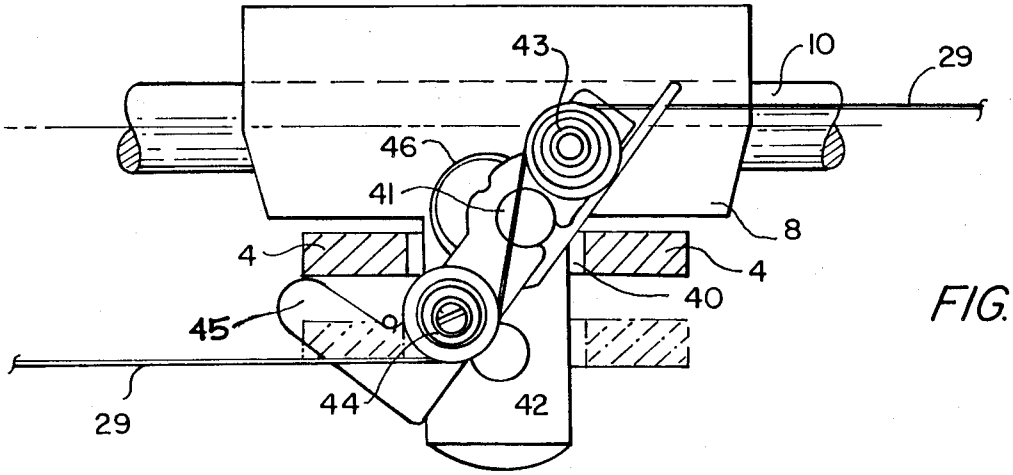
FIG. 3 shows the portion enclosed in the circle X of FIG. 2, on a larger scale.

Between the two cable ends, which are secured as described above, the Bowden cable control travels over two rollers 43, 44, which are supported on an actuating lever 42 such that they are rotatable about axes parallel to the guide rail 6. The actuating lever 42 as shown FIG. 3 is secured on the guide bearing 8 such that it is pivotable about a journal 41, that is, about an axis extending parallel to the guide rail 6. The actuating lever also extends through the guide slit 40 of the writing arm 4, so that it has a section located above the writing arm 4. The section of the actuating lever located below the journal 41 and bearing the roller 44 is at least partly always located underneath the writing arm 4. A spiral spring 46 is supported with one end in the guide bearing 8 and with its other end below the journal 41 on the actuating lever 42, and therefore, continuously exerts a force upon the actuating lever 42 in the direction of pivoting a writing position. On the lower end, that is, below the roller 44, the actuating lever 42 has a protrusion 42' that may be embodied by bending the lever, that is, the actuating lever substantially is L-shaped. The protrusion 42' is located laterally towards the guide slit 40 and below the writing arm 4 in all of the operating positions of the actuating lever 42, to be described.

As shown, the sections of the Bowden cable control located on both sides of the guide bearing 8 extend parallel to the guide rail 16. When the lifting magnet 34 is energized, it compresses the spring 36, so that the Bowden control 29 is "relaxed". As a result the spiral spring 46 presses the actuating lever 42, (and its sections supporting the rollers 43 and 44), into a substantially upright position, so that the section 45' extends approximately horizontally. The writing arm is thus lowered into the position shown in phantom lines in FIG. 3, or into the writing position. If a displacement of the writing arm parallel to the guide rail is performed in this position (that is, if the guide bearing 8 slides along the runner rail 10), then the position of the actuating lever 42 does not change, because the rollers 43 and 44 "slide" along the Bowden control 29, and the spiral spring 46 continues to act upon the actuating lever 42.

In order to raise the writing arm 4 out of the phantom position of FIG. 3 into the position shown in solid line in FIG. 3 (and thus into its position of repose), the lifting magnet 34 is deprived of electrical current, so that the compression spring 36 displaces its tappet 35 (FIG. 1) downward. As a result, the tensile strain in the Bowden cable control 29 notably is increased. Hence, the Bowden cable control, via the contact zone on the roller 44 in the contact zone on the roller 43, then exerts forces upon the rollers and thus exerts torque upon the actuating lever 42, which is pivoted clockwise by this torque, and counter to the force of the spiral spring 46, and into the solid line position shown in FIG. 3. In this process the outer end of its section 45' is raised, and this section, because of its contact with the lower surface of the writing arm 4, raises the writing arm into its position of repose.

The lifting magnet 34 is energized once again, the action of the sprial spring 46 will pivot the actuating lever 42 back into a substantially upright position, as described above, for its section bearing the rollers 43 and 44, because the tensile strain in the Bowden cable control 29 again has been reduced sharply.

While I have described a preferred embodiment of my invention, it is understood that the invention is to be defined by the scope of the appended claims.

I claim:

1. In a lettering device of the type having a keyboard portion for selecting the symbols to be written and a writing portion, optionally separate from the keyboard portion, which has a writing arm (4) receiving a stylus (5) and movable between a position of repose and a writing position, which is movable by means of two motors (15, 25) driven in accordance with the symbol to be written along cartesian coordinates (X, Y) wherein the motors (15, 25) are disposed stationary relative to the coordinate origin and wherein the writing arm (14) is secured such that it is movable in the direction of one coordinate on a guide rail (6), this guide rail being movable by the first motor (15) in the direction of the other coordinate, and such it is movable in the direction of the other coordinate on a second guide rail (16), which is movable in the direction of the first coordinate by the second motor (25), and has a guide slit (40) extending in the direction of its longitudinal extension and in the direction of the first guide rail (6), in which a guide bearing (8) is guided, which is slideably coupled to a stationary runner rail (10) extending parallel to the second guide rail (16) the improvement which comprises an actuating lever (42) that is pivotable about a pivot axis (41) extending parallel to the first guide rail (6) and is secured to the guide bearing (8) and further is in displaceable engagement, with a Bowden cable (29) through a cable engaging means (43, 44) located on different sides of the pivot axis (41) and spaced apart therefrom, with said Bowden cable (29) further extending parallel to the runner rail (10), and being connected to means to control cable tension, wherein the actuating lever is movable by varying the tension in the Bowden cable (29), to rotate the cable engaging means and the actuating lever between a lowered position, in which the writing arm (4) is located in the writing position, and a raised position, wherein further a section (42'), of the actuating lever is in lifting engagement with the writing arm (4).

2. A lettering device as defined by claim 1, characterized in that the cable engaging means comprise rollers (43, 44) secured to the guide bearing (8) such that they are rotatable about axes parallel to the pivot axis (41) of the actuating lever (42).

3. A lettering device as defined by claim 1, characterized in that the cable engaging means comprises a pair of rollers (43, 44) secured to the guide bearing (8) such that they are rotatable about axes parallel to the pivot axis (41) of the actuating lever (42).

4. A lettering device as defined by claim 1, characterized in that the section of the actuating lever (45) comprises a protrusion (42') provided underneath the lower application zone (44) and extending crosswise to the pivot axis (41) of the actuating lever (42).

5. A lettering device as defined by claim 2, characterized in that the section of the actuating lever (42) comprises a protrusion (45') provided underneath the lower application zone (44) and extending crosswise to the pivot axis (41) of the actuating lever (42).

6. A lettering device as defined by claim 1, characterized in that the tension control means comprises one end of the Bowden cable that is non-displaceably retained, and the other end being secured to a lifting device (34,35,36).

7. A lettering device as defined by claim 2, characterized in that the tension control means comprises one end of the Bowden cable that is non-displaceably retained, and the other end being secured to a lifting device (34,35,36).

8. A lettering device as defined by claim 3, characterized in that the tension control means comprises one end of the Bowden cable that is non-displaceably retained, and the other end being secured to a lifting device (34,35,36).

9. A lettering device as defined by claim 1, characterized in that the tension control means comprises one end of the Bowden cable that is non-displaceably retained, and the other end being secured to a lifting device (34,35,36).

10. A lettering device as defined by claim 6, characterized in that the lifting device (34,35,36) is a lifting magnet.

11. A lettering device as defined by claim 7, characterized in that the lifting device (34,35,36) is a lifting magnet.

12. A lettering device as defined by claim 8, characterized in that the lifting device (34,35,36) is a lifting magnet.

13. A lettering device as defined by claim 8, characterized in that the lifting device (34,35,36) is a lifting magnet.

14. A lettering device as defined by claim 9, characterized in that the lifting device (34,35,36) is a lifting magnet.

* * * * *